US010807144B2

(12) United States Patent
Sedlacek

(10) Patent No.: US 10,807,144 B2
(45) Date of Patent: Oct. 20, 2020

(54) TOOL FOR CURLING OF CAN NECKS

(71) Applicant: MORAVIA CANS a.s, Bojkovice (CZ)

(72) Inventor: Jan Sedlacek, Louka (CZ)

(73) Assignee: MORAVIA CANS A.S., Bojkovice (CZ)

( * ) Notice: Subject to any disclaimer, the term of this patent is extended or adjusted under 35 U.S.C. 154(b) by 219 days.

(21) Appl. No.: 15/848,284

(22) Filed: Dec. 20, 2017

(65) Prior Publication Data

US 2019/0184444 A1 Jun. 20, 2019

(51) Int. Cl.
*B21D 51/26* (2006.01)
*B65D 1/16* (2006.01)

(52) U.S. Cl.
CPC ..... *B21D 51/2623* (2013.01); *B65D 1/165* (2013.01)

(58) Field of Classification Search
CPC ..... B21D 41/04; B21D 51/2623; B21D 51/2638; B21D 19/12; B21D 51/2615; B21D 51/263; B21D 51/30; B21D 51/32
USPC ..... 72/370.02, 370.1, 370.11; 413/71, 72, 413/73, 74
See application file for complete search history.

(56) References Cited

U.S. PATENT DOCUMENTS 2,680,550 A * 6/1954 Pechy ..... B65B 7/2842 53/317
2,878,632 A * 3/1959 Foresman, Jr. ..... B65B 7/285 53/330
2,975,575 A * 3/1961 Nalbach ..... B65B 7/285 53/330
3,646,840 A 3/1972 Bozek ..... 82/82
3,757,717 A * 9/1973 Bennett ..... B21D 51/34 413/34
3,878,743 A 4/1975 Melind ..... 82/54
4,723,430 A * 2/1988 Hahn ..... B21D 51/2615 29/421.1
5,355,709 A * 10/1994 Bauder ..... B21D 22/30 72/356
5,902,086 A * 5/1999 Enoki ..... B21D 51/2646 413/69
2009/0218349 A1* 9/2009 Metzger ..... B65D 7/04 220/316
2011/0011896 A1 1/2011 Diamond et al. ..... 222/394
2012/0243963 A1* 9/2012 Larroche ..... B21D 39/20 413/1

FOREIGN PATENT DOCUMENTS

EP 0 275 369 B1 5/1992
EP 1 531 952 B1 8/2006
EP 1 731 239 B1 9/2009
EP 1 461 232 B1 10/2010
EP 2 103 370 B1 5/2012

* cited by examiner

*Primary Examiner* — Adam J Eiseman
*Assistant Examiner* — Stephen Floyd London
(74) *Attorney, Agent, or Firm* — Ostrolenk Faber LLP

(57) ABSTRACT

A tool for curling of can necks as part of a tool plate that includes an expansion control device for controlling of the spreading of a collet, a collet clutch, an interconnecting means provided with a stop mechanism, and a holder being fixed in the collet clutch at its one end, the collet being arranged on its other end, the collet in the non-active position being insertable into the can to permit segments of the collet to spread in the direction of the device.

5 Claims, 5 Drawing Sheets

TOOL FOR CURLING OF CAN NECKS

TECHNICAL BACKGROUND

The invention relates to forming of cans.

STATE OF THE ART

Metal cans made from aluminium and aluminium alloys or from steel are widely used in the packaging industry for drinks, cosmetics, food industry or for technical use. Most produced cans are pressure aerosol cans which contain a variety of products such as deodorants, hairspray, shaving foam, lacquers or paints, oils, etc. The second most produced cans are beverage cans.

Cans are currently mass production goods that need to be produced economically in the largest quantities. That is why there are specially developed production lines that carry out an optimized production process. Such lines are described in blocks or in parts in EP 2 103 370 B1, EP 0 275 369 B1, U.S. Pat. No. 3,646,840 or 3,878,743.

From the manufacturing point of view, the cans are divided in one-piece (monobloc) cans or multi-part cans.

To form a monobloc can, an input blank is first shaped to form a cylindrical hollow body. As a rule, backward extrusion or D&I (Draw and Ironed) technology is used. Such procedures are described, for example, in EP 1 531 952 B1, EP 1 731 239 B1 or 1 461 232 B1. As an input material, an aluminum slug is used for backward extrusion, from which a hollow body is formed by one stroke of a press ram. The slug diameter is approximately the same as the diameter of the can that is formed.

In the D&I (Draw and Ironed) technology, there are discs stamped from a rolled sheet of aluminium or steel, which is then shaped into cup (Cupper machine) and further reduced by further redrawing and ironing operations to the desired diameter and thickness of the can wall (Bodymaker machine). Then it is necessary to create a shoulder of the can and curl the can rim, which is a problem when forming steel cans because steel is more resistant than aluminium.

For shaping of a can shoulder a necking machine is used. The most common necking machine, which is shown in FIG. 10, comprises a revolving plate 48 which performs rotational intermittent or stepping motion and is equipped with a plurality of clamping stations 3 arranged along its circumference. The purpose of the clamping stations 3 is to temporarily hold the can 2, typically by means of pneumatically expandable rings. The machine further comprises the opposite tool plate 4 which is capable of performing a reciprocating motion and carries the forming tools 47 arranged in fixed positions along its circumference. The individual tools serve for shaping the upper edge of the hollow body of the can in an progressive manner until the latter assumes its final shape including a rim.

The document US2011/0011896 A1 discloses a method of curling a steel tube by either gradual necking, as it is the case of aluminium cans, or by introducing additional heating with ultrasonic vibration for better formability.

Such procedures can function when it concerns a favourably shaped shoulder (e.g., a curved shoulder) which has higher resistance to axial load and hence a greater resistance to deformation during forming of the shoulder and curling on gradual necking machines—see FIG. 10. However, a hollow can with a shoulder having a relatively sharp angle relative to the plane perpendicular to the axis of the can, may have a reduced resistance to axial load. Thus, the force from the forming tool may exceed the axial resistance of the can resulting in the deformation of the shoulder, especially during the curling process. The deformation during curling operation may also occur due to the thin wall of the can's shoulder or when using a material with higher deformation resistance (aluminium alloys, steel).

The aim of the present invention is to provide a device for curling of the neck of cans having reduced axial strength due to an unfavourable shoulder shape, or a thin wall, or a material with higher deformation resistance (aluminium alloy, steel).

SUMMARY OF THE INVENTION

The above mentioned deficiencies are eliminated by a tool for curling of can necks according to the invention, which is characterised by the fact that it comprises an expansion control device for controlling of the spreading of a collet in which is with one end by means of a collet clutch, which is inside of the expansion control device arranged interconnecting means provided on the other end with a stop mechanism, wherein in the collet clutch a holder is fixed with its one end, and on its other end the collet is arranged, the collet in the non-active position is insertable into the can, and segments of the collet are spreading in the direction to the device.

BRIEF DESCRIPTION OF DRAWINGS

The invention will be further described using drawings, where.

PREFERRED EMBODIMENTS OF THE INVENTION

Figure 1:
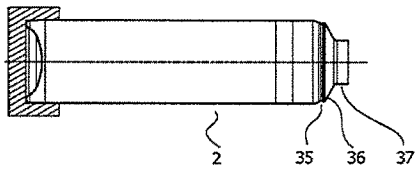
FIG. 1 is a view of a can before curling.
Figure 2:
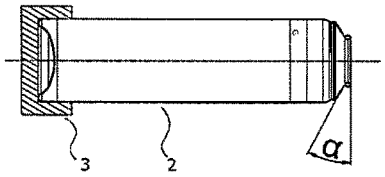
FIG. 2 is a view of a can after curling.

As shown in FIG. 1, in a schematic cross-section view, the can 2, before curling of its neck 37, is provided with a seat 35 for fixation of the plastic cover and with a shoulder 36 with a relatively sharp angle to the plane which is perpendicular to the axis of the can 2. This sharp angle $\alpha$ (FIG. 2) is in the range 10 to 50° with respect to the plane, which is perpendicular to the longitudinal axis of the can 2, as shown in FIG. 2, is, in combination with the thickness of the wall and the material of the can 2, the reason for the buckling of the can 2 caused by the pressure of the tools from above.

Figure 9:
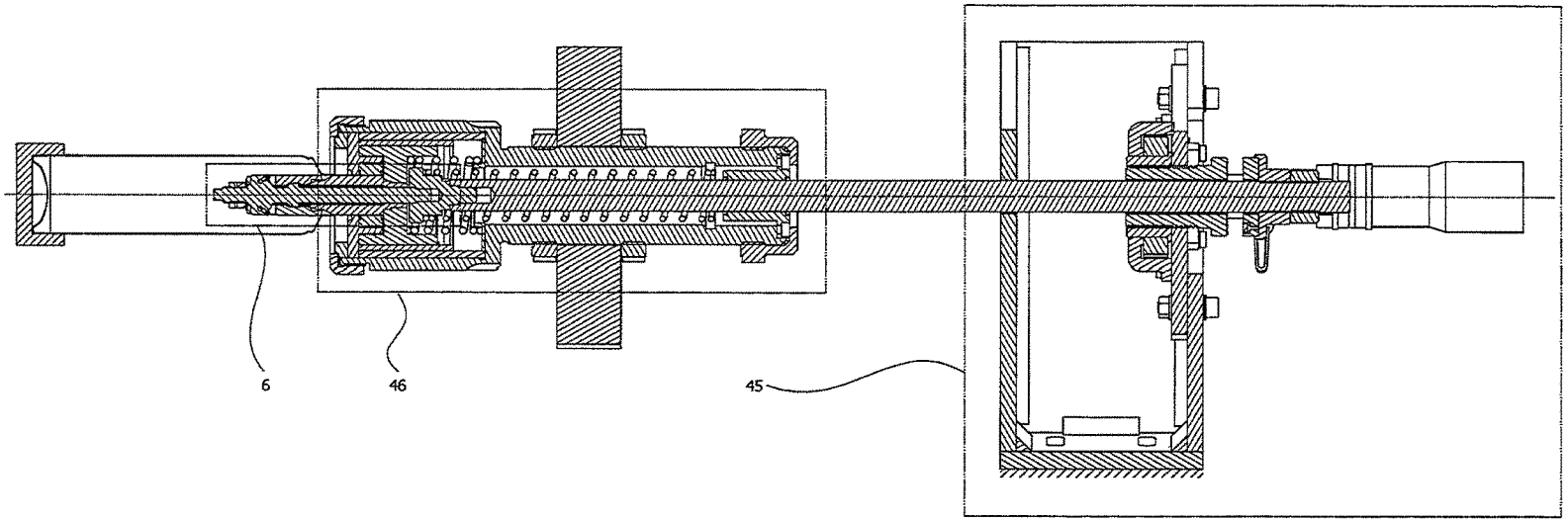
FIG. 9 is a systematic illustration of the main parts of the tool according to the invention and FIG. 10 is schematic illustration of a necking machine.
Figure 10:
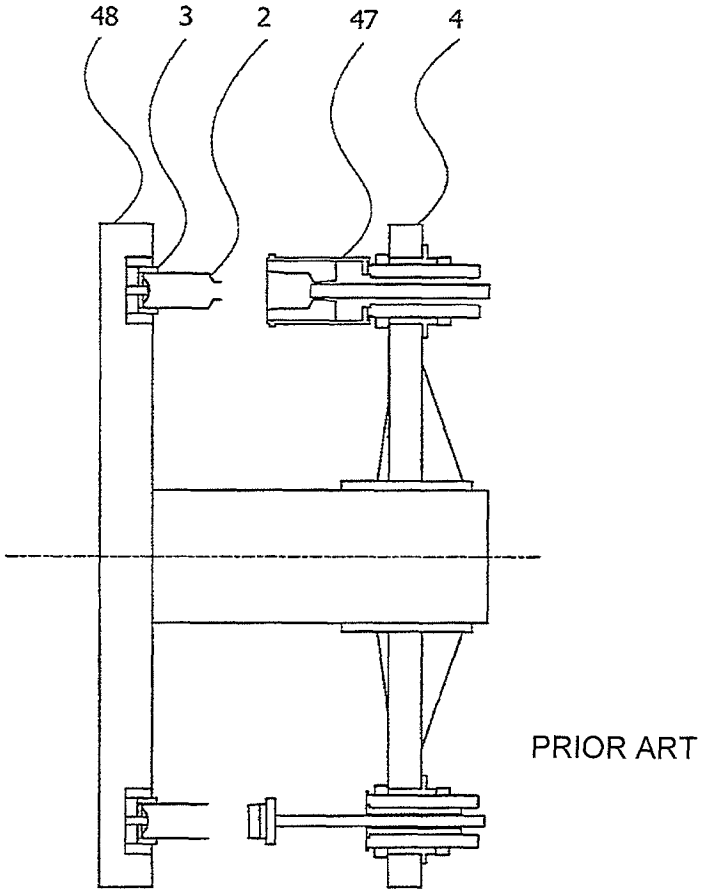

The main parts of the tool 1 for curling of the can neck 37 are expansion control device 46, collet 6 and stop mechanism 45, which can be seen in FIG. 9. The expansion control device 46 has as an outer body 20 (see FIG. 3) in which parts for controlling the segments 12 of the collet 6 are arranged. The cooperating stop mechanism 45 activates said parts for controlling the segments 12 of the collet 6. The expansion control device 46 and stop mechanism 45 are connected by an interconnecting means, namely a rod 9.

Figure 3:
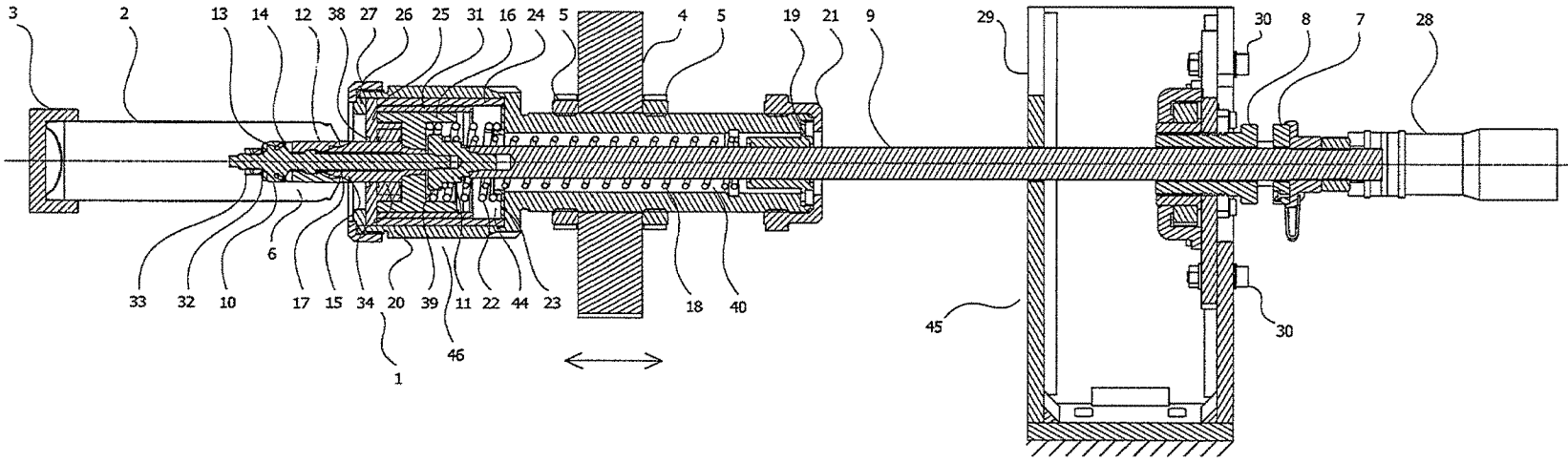
FIG. 3 represents a tool in an initial position inside of the can.
Figure 4:
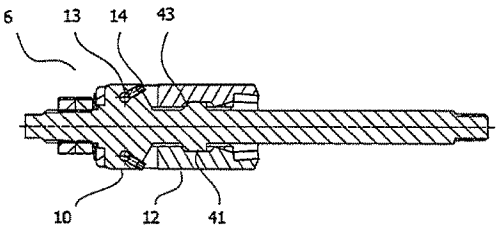
FIG. 4 is a detailed view of a collet of the tool.

Referring to FIG. 3, the tool 1 according to the invention is inserted through the neck 37 into the can 2. This is the initial position inside the can 2. FIG. 4 shows a detailed view of the collet 6 mechanism.

In general, it can be noted for better orientation that the can 2 is clamped in a clamping center 3. The tool 1 is clamped through the outer body 20 in the tool plate 4 by means of nuts 5. The tool plate 4 performs a linear reciprocating movement in the direction of the double arrow.

Figure 7:
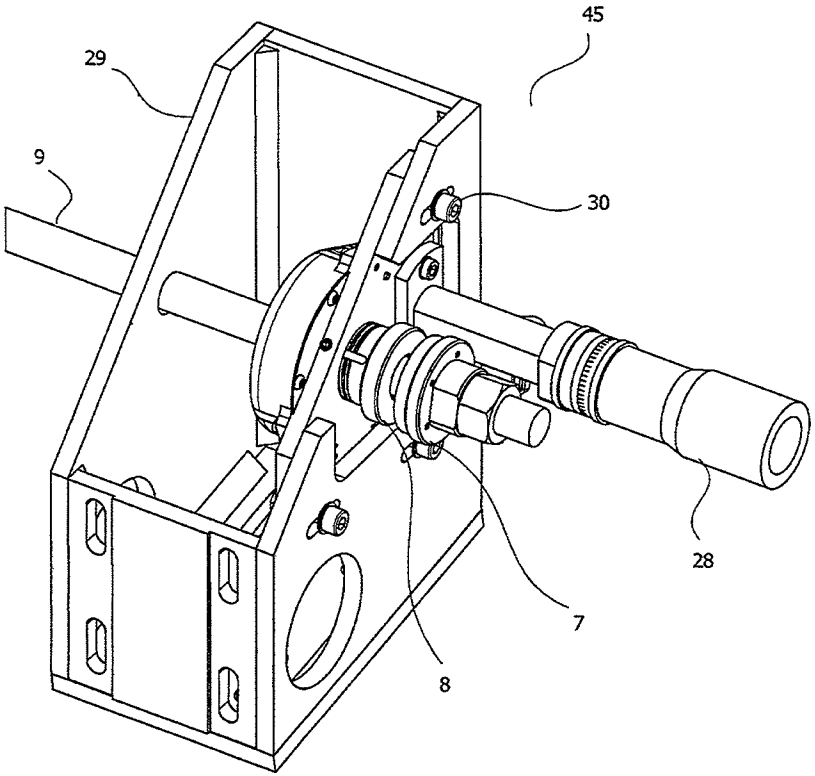
FIG. 7 is a perspective view of parts of a stop mechanism.

A frame 29 of the stop mechanism 45 is arranged opposite to the clamping center 3 in the direction of the outer body. On the rod 9, a movable stop 7 is provided which cooperates with the fixed stop 8. The position of the fixed stop 8 is adjustable by means of a pivoting mechanism 28, which is mounted on the frame 29 using screws 30. This is well seen in FIG. 7.

The outer body 20 has two hollows, namely a rear hollow 40 and a front hollow 44. The rear hollow 40 is terminated by a bearing 19 and the rod 9 passes through bearing 19, around which a main spring 18 is provided. In the front hollow 44 there are arranged mechanical elements controlling the movement of segments 12 of the collet 6.

Into the front hollow 44 of the outer body 20 extends the end of the rod 9 on which a collet clutch 11 is fastened. A holder 10 is fastened at one of its ends to the clutch 11, and at the other end of the holder 10 segments 12 of the collet 6 are arranged swingably from the basic closed to the opened position. Segments 12 are provided on the inner side with a transverse groove 43 enclosing in a close position a collar 41 provided on the holder 10. On the holder 10 an extension mandrel 15 is provided slidingly which spreads out the segments 12 of the collet 6 and which is firmly arranged in an inner cylinder 16. The inner cylinder 16 is arranged movably within the guide cylinder 24. In the hollow of the outer body 20, and between the guide cylinder 24 and the inner cylinder 16, there is a roller or a plain bearing 31 rigidly arranged. The inner cylinder 16 has a front cavity oriented towards the segments 12 of the collet 6 and a rear cavity facing towards rod 9. A curling flange 25 with a curling profile 38 is mounted at an inner edge, and at the front cavity of the inner cylinder 16. The curling profile 38 then curies the neck 37.

A main spring 18 abuts with one end of the seat the inner cylinder 16 in the front hollow 44 and with the other end the bearing 19, terminating in the rear hollow 40. A front spring 22 is arranged in the front hollow 44 of the clutch seat 39 mounted at one side of the clutch seat 39 and at the other side in the spacer 23 on the wall of the front hollow 44 of the outer body 20.

FIG. 3, therefore, illustrates the condition when the segments 12 of the collet 6 of the tool 1 are already inside the can 2 but they are still in the closed position.

Figure 5:
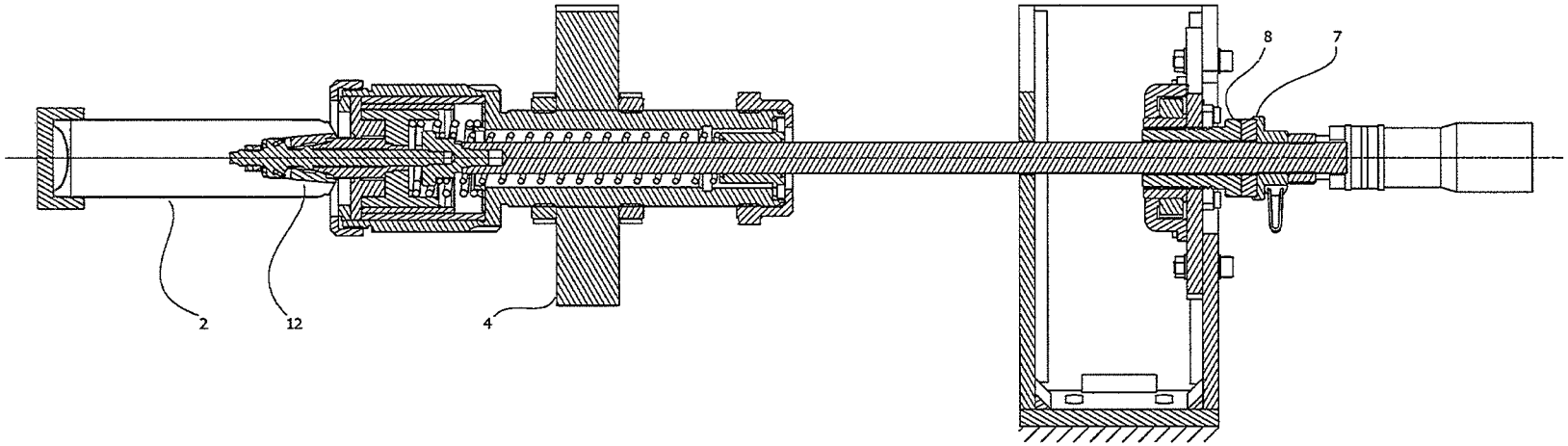
FIG. 5 represents a tool in the initial phase of curling.

In the subsequent forward movement of the tool 1 shown in FIG. 5, the movable stop 7, which is arranged on the rod 9, comes into contact with the fixed stop 8, which is arranged on the mechanism 28 which is fixed on the frame 29 by means of screws 30. Thus, the parts of the tool 1, such as the rod 9, the holder 10 of the collet 6, segments 12, and the collet clutch 11 stop to perform forward movement. The collet clutch 11 is firmly arranged on the rod 9 and in the collet clutch 11 the holder 10 of the segments 12 is then firmly arranged. With further forward movement of the tool plate 4 and thereby of the tool 1, the segments 12 of the collet 6 are spread out. The forward movement is forced by the leading surface of the expansion mandrel 15, while a main spring 18 is simultaneously compressed. This main spring 18 is arranged at one end in the clutch seat 39 of the collet clutch 11 and the other end of the main spring 18 abuts the front face of the bearing 19 by which it is compressed and which is attached to the outer body 20 of the tool 1 by a sleeve nut 21. The outer body 20 is a relatively long part extending over both sides of the tool plate 4. The forming tool, which is a curling flange 25 with a curling profile 38, is arranged in the front face of the outer body 20.

The segments 12 of the collet 6 are provided on the inner side with a transverse groove 43 which engages in the rest position into the collar 41 on the holder 10. This is clearly seen in FIG. 4. Segments 12 of the collet 6 are spreading out in the direction to the device 46.

The segments 12 of the collet 6 are attached to the holder 10 by means of pins 13 which are locked by screws 14. The angle of opening of the segments 12 of the collet 6 is determined by the geometry of the expanding mandrel 15 which is screwed into the inner cylinder 16. This inner cylinder 16 is arranged movably in the guide cylinder 24 which is on the contrary arranged firmly at the front face of the outer body 20. The end position of the opening of the segments 12 of the collet 6 is determined by the front contact of the expanding mandrel 15 and by the collar 41 of the holder 10. The holder 10 of the segments 12 of the collet 6 is arranged in the expanding mandrel 15 by means of sliding bush 17.

Figure 6:
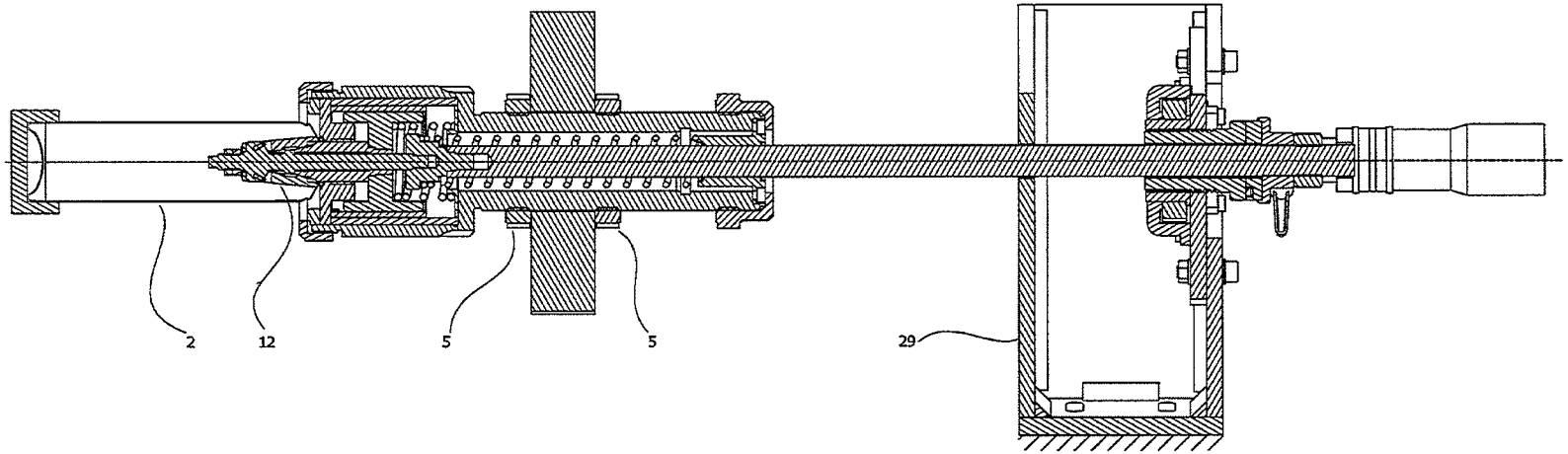
FIG. 6 represents a tool in the end phase of the can curling.
Figure 8:
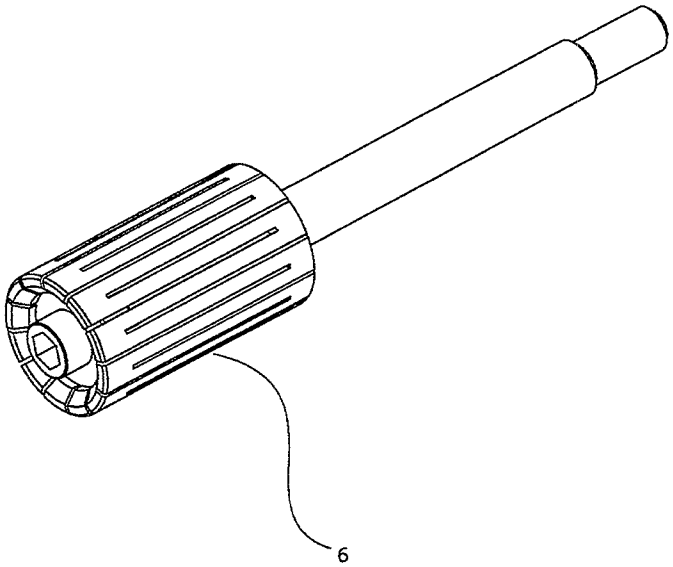
FIG. 8 is an alternative embodiment of a collet.

After the contact of the expansion mandrel 15 with the collar 41 of the holder 10 of the segments 12 of the collet 6, the forward movement of the expansion mandrel 15 and of the inner cylinder 16 is prevented. Due to this, the front spring 22, which is placed at one side in the clutch seat 39 and at the other side in a spacer 23, is compressed. At the same time, there is a mutual axial movement between the inner cylinder 16, the roller or plain bearing 31 and the guide cylinder 24 which is arranged in the outer body 20 of the tool 1. At the same time, the curling flange 25, which is mounted in the outer body 20 of the tool 1 and delimited by the guide cylinder 24 from the inner side and by a spacer ring 26 with locking nut 27 from the outer side, is moving along the cylindrical surface of the expanding mandrel 15 by means of the bearing 34. Due to this movement, the curling profile 38 makes contact with the neck 37 of the can 2 and curls the can 2. This state is shown in FIG. 6.

This allows the curling of the can 2 without causing any deformation, as it is supported from inside by the expansion collet 6 of the tool 1.

The axial position of the segments 12 of the collet 6 is adjustable relative to the shoulder 36 of the can 2 by the pivoting mechanism 28 which is attached to the frame 29 of the stop 8 by means of screws 30.

During the reciprocating movement, the curling flange 25 with the curling profile 38 is moved away from the neck 37 of the can 2 and then the segments 12 of the collet 6 are returned into their initial position. The segments 12 of the collet 6 are returned to the initial position by means of a bellewille spring 32 the preload of which can be controlled by adjusting nuts 33. Subsequently, the contact between the movable stop 7 and the fixed stop 8 is interrupted. Then, the axial reciprocating movement of the rod 9, of the holder 10 of the segments 12 of the collet 6 and of the clutch 11 together with the entire tool 1 assembly is performed, and the expansion collet 6 is pulled out of the interior of the can 2.

So the result of the work with above described tool is a one-piece can 2 of steel sheet with the curled neck 37 provided by the seat 35 for fixation of the plastic cover, and the can 2 is provided with the straight shoulder 36 formed at an angle of 10 to 50° with respect to the plane perpendicular to the longitudinal axis of the can 2.

The invention claimed is:

1. A tool for curling of a one-piece can's neck as a part of a tool plate, comprising:

a collet having spreadable segments;

a collet clutch;

interconnecting means comprising a rod connected at one end to the collet clutch;

a holder fixed at one end to the collet clutch and having the spreadable segments mounted thereon;

an expansion mandrel arranged on the holder and movable toward the segments to make contact with the segments;

a curling flange movable toward the segments and having a curling profile to receive and fold the can's neck;

wherein the segments of the collet in a non-active state are insertable into the can through the can's neck, and spread inside of the can to make contact with the interior of the can in response to urging by the expansion mandrel as the expansion mandrel is moved toward the segments with the rod, and wherein the can's neck is received and folded in the curling profile when the curling flange is moved toward the can with the rod after the segments make contact with the interior of the can to support the interior of the can.

2. The tool according to claim 1, further comprising an outer body fixed on the tool plate and moveable in a straight-line, reciprocating manner, the outer body having a rear hollow and a front hollow.

3. The tool according to claim 2, wherein each of the segments of the collet is provided, on an inner side thereof, with a transverse groove surrounding, in a rest position, a collar provided on the holder, wherein the expansion mandrel is arranged in the front hollow in an inner cylinder and the inner cylinder is movably mounted in a guide cylinder, wherein the guide cylinder is firmly arranged in the front hollow of the outer body, wherein, between the guide cylinder and the inner cylinder, a roller or plain bearing is arranged, wherein in the rear hollow a main spring is arranged, wherein the main spring abuts with one end thereof a seat of the inner cylinder and with another end thereof abuts a bearing terminating in the rear hollow, wherein a front spring is arranged around the main spring in the front hollow of the outer body, wherein the front spring is arranged at one side thereof in the collet clutch and at another side thereof in a spacer on a front wall of the front hollow of the outer body.

4. The tool according to claim 1, further comprising a frame, a stop connected to another end of the rod; and a fixed stop arranged in the frame and axially movable relative to the frame, the fixed stop being arranged to prevent movement of the stop connected to the rod to stop movement of the rod.

5. The tool according to claim 4, wherein the fixed stop is axially movable relative to the frame with a pivoting mechanism which is attached to the frame by screws.

* * * * *